United States Patent [19]

Noll, Jr.

[11] Patent Number: 4,564,189

[45] Date of Patent: Jan. 14, 1986

[54] ARTICULATING SHEET MATERIAL CONVEYOR

[75] Inventor: Harry C. Noll, Jr., Rouses Point, N.Y.

[73] Assignee: Harris Graphics Corporation, Melbourne, Fla.

[21] Appl. No.: 601,806

[22] Filed: Apr. 19, 1984

[51] Int. Cl.[4] ..... B65H 29/14; B65H 29/50; B65H 31/32

[52] U.S. Cl. ..... 271/201; 271/218; 414/91

[58] Field of Search ..... 271/201, 200, 198, 199, 271/202, 203, 217, 218, 219, 189, 303; 414/91, 88

[56] References Cited

U.S. PATENT DOCUMENTS

| | | | |
|---|---|---|---|
| 3,331,516 | 7/1967 | Gübeli | 271/201 X |
| 3,880,059 | 4/1975 | Brockmüller | 414/91 |
| 3,908,985 | 9/1975 | Wiseman | 271/199 X |

FOREIGN PATENT DOCUMENTS

| | | | |
|---|---|---|---|
| 1261449 | 6/1965 | Fed. Rep. of Germany | 271/201 |
| 0101548 | 8/1980 | Japan | 271/200 |

*Primary Examiner*—Bruce H. Stoner, Jr.
*Assistant Examiner*—Lawrence J. Goffney, Jr.
*Attorney, Agent, or Firm*—Yount & Tarolli

[57] ABSTRACT

A method and apparatus are disclosed for transporting sheet materials from a source location to a stacking workstation. A lower conveyor is positioned between the source location and the stacking work station. An upper conveyor having a first conveyor section and a second conveyor section is positioned above the lower conveyor such that the first conveyor section is above an end portion of the lower conveyor and the second conveyor section extends beyond the the downstream end of the lower conveyor. The first conveyor section is pivotably fixed at an upstream end. The upstream end of the second conveyor section is pivotably attached adjacent the downstream end of the first conveyor section. The downstream end of the second conveyor section is adapted to be operatively coupled to the top of the stack of sheet materials being stacked on a movable support of the stacking workstation. When sheet materials enter between the lower conveyor and the first conveyor section, the first conveyor section pivots because of the profile of the sheet materials. The second conveyor section pivots with respect to the first conveyor section keeping the downstream end of the second conveyor section operatively coupled to the top of the stack of sheet materials being stacked. A sensor is provided to sense vertical position of the top of the stack of sheet materials being stack on the movable stacking support. The movement of the movable support of the stacking workstation is controlled responsive to the sensed vertical position of the top of the stack of sheet materials being stacked.

13 Claims, 11 Drawing Figures

ARTICULATING SHEET MATERIAL CONVEYOR

DESCRIPTION

1. Technical Field

The present invention relates to a method and apparatus for transporting sheet materials such as signatures from a source location to a stacking workstation and more particularly to a method and apparatus for transporting shingled sheet materials and slugs of sheet materials from a source location to a stacking workstation utilizing a lower conveyor and an articulating upper conveyor assembly.

2. Background Art

Conveyor feeding systems that transport sheet materials from a source location to a stacking workstation are well known in the art. Such systems typically have a lower conveyor to transport the sheet materials. The feed path just prior to the stacking workstation includes an upper conveyor positioned above and cooperating with the lower conveyor to sandwich the sheet materials prior to feeding them onto a platform of the stacking workstation. The sandwiching of the sheet materials is necessary to counter the effects of gravity since the feed path just prior to the stacking platform is typically inclined downward with respect to horizontal to aid in the stacking process.

Stackers for receiving sheet materials such as signatures or newspapers in a stream and for forming them into stacks are well known. Typical are the stackers shown in U.S. Pat. Nos. 4,139,191; 4,037,525; 3,851,773; 3,538,818; 3,479,932; 3,450,275; 3,480,503; and 2,672,079. These stackers receive a stream of publications, form them into stacks and deposit them on a conveyor for subsequent handling.

One particular type of stacker includes a platform that moves downward as the sheet materials are being stacked on the platform. Such a stacker is disclosed in a pending application of Mohanjit Singh Chandhoke entitled "Apparatus for Forming a Stack of Signatures", U.S. Application Ser. No. 518,015, which is assigned to the assignee of this invention. With the type of stacker disclosed in Mr. Chandhoke's application, it is desirable to retain the top of the stack of sheet materials on the stacking platform at a constant vertical position within predetermined limits. Such a stacker may include a counter positioned upstream of the stacking workstation for counting the number of signatures being fed to a stack. Sensors may be utilized to determine stack dimensions. When a predetermined number of signatures needed to complete a stack is counted or a sufficient amount of signatures have been fed to complete a stack of predetermined dimension, a gapper apparatus, positioned upstream along the conveyor feed path, interrupts the flow of the sheet materials. A gap is thus formed in the stream of sheet materials. After a predetermined delay, the gapper apparatus releases the sheet materials and the stream continues. A slug of sheet materials will be present at the beginning of the next group of sheet materials to be stacked, the slug being caused by the gapper stopping the flow of sheet materials while the conveyor continued to drive the remainder of the sheet materials located upstream of the gapper. After a stack is completely formed at the stacking workstation, the stacking platform holding the completed stack descends downward to make room for a new succeeding stack and to move the completed stack to an intermediate platform. An interceptor is immediately positioned when a gap is sensed to accept sheet materials which will form the next stack. The formation of a gap is necessary to provide sufficient time for proper operation of the movable platform and operation of the interceptor. The completed stack is transferred from the platform to the intermediate platform where it is held until clamped and removed. After the previously formed stack is removed from the stacker, the platform ascends and meets the descending interceptor to take over the holding function of the new stack being formed. The interceptor is then retracted and is repositioned ready to accept the next stack to be formed after another gap is sensed.

Stackers having a movable platform move the platform at one or more predetermined speeds. Typically, there is a low speed utilized for stacking a present group of signatures and a high speed utilized to quickly move a completed stack of signatures downward out of the way. Since sheet materials feeding onto the stacking platform may not arrive at a steady feed rate, the top of the stack being formed can vary from a desirable vertical position of being even with or slightly below the downstream end of the lower conveyor.

Another problem with conveyor and stacker systems is that the conveyors do not compensate for profile variances that occur within the stream of incoming sheet materials. As mentioned, slugs occur on a periodic basis caused by a gapper apparatus. Slugs can also form during vertical feeding of sheet materials. The top of a stacker is typically several feet above the floor. To get the sheet material to this height, there is typically a vertical conveyor feed section that carries the sheet materials vertically upward. If the conveyor belts in the vertical feed section are not adjusted to a proper tension, gravity can cause slugs to form.

DISCLOSURE OF THE INVENTION

In accordance with this invention there is provided a new and improved method and apparatus for transporting sheet materials from a source location to a stacking workstation. In accordance with the present invention, a lower conveyor is positioned between the source location and the stacking workstation. An upper conveyor is positioned above the lower conveyor just prior to the stacking workstation to sandwich sheet materials being fed to the stacking workstation. The upper conveyor articulates at a location near the downstream end of the lower conveyor in response to changes in profile of incoming sheet materials. The downstream end of the upper conveyor is retained operatively coupled with the top of the stack of sheet materials being stacked on a stacking platform. A vertical position sensor is operatively coupled to the top of the stack of sheet materials being stacked. The stacking platform of the workstation is moved downward at a rate responsive to the sensed vertical position of the top of the stack of sheet materials being stacked.

In the disclosed and preferred embodiment, an apparatus for feeding a stream of sheet materials from a source location to a stacking workstation includes a lower conveyor located between the source location and the stacking workstation. The lower conveyor transports sheet materials from the source location to the stacking workstation. An upper conveyor including a first conveyor section is positioned above an end portion of the lower conveyor near the stacking workstation. The first conveyor section and the lower conveyor sandwich the stream of sheet materials therebetween as the sheet materials are transported to the stacking workstation. The first conveyor section is pivotably fixed at an end upstream of the stacking workstation. The upper conveyor further includes a second conveyor section pivotably mounted adjacent a downstream end of the first conveyor section. The second conveyor section extends beyond a downstream end of the lower conveyor and over a movable stacking support of the stacking workstation. A downstream end of the second conveyor section is adapted to be operatively coupled to the top of a stack of sheet materials being stacked on the movable stacking support. Sheet materials entering the sandwich portion between the first conveyor section and the lower conveyor section causes the downstream end of the first conveyor section to pivot away from the lower conveyor in response to the profile of the sheet materials. The second conveyor section pivots with respect to the first conveyor section retaining the downstream end of the second conveyor section operatively coupled to the top of the stack of sheet materials being stacked on the movable stacking support. A drive means is provided operatively connected to the lower conveyor and the upper conveyor for driving belts on the lower and the upper conveyors.

A method for feeding a stream of sheet materials from a source location to a stacking workstation in accordance with the present invention comprises the steps of providing a lower conveyor located between the source location and the stacking workstation. Another step is providing an upper conveyor positioned above a downstream end portion of the lower conveyor and extending beyond the end portion of the lower conveyor, a downstream end of the upper conveyor being operatively coupled with the top of a stack of sheet material being stacked on a movable stacking platform of the stacking workstation. Another step is driving the upper and lower conveyors to transport sheet materials to the stacking workstation, sheet materials being sandwiched between the upper and lower conveyors where the upper conveyor is above the end portion of the lower conveyor, such section defining a sandwich portion of the upper and lower conveyors. Another step is pivoting the upper conveyor with respect to the lower conveyor at an upstream location responsive to sheet material profile entering the sandwich portion of the upper and lower conveyors. Another step is articulating the upper conveyor near the downstream end of the lower conveyor, the downstream end of the upper conveyor remaining operatively coupled to the top of the stack of sheet materials being stacked on the movable stacking platform of the stacking workstation.

Another feature of the invention is the provision for a vertical component sensing means operatively coupled to the top of a stack of sheet materials being formed on the movable stacking platform. This sensing means senses vertical position of the top of the stack of sheet materials being stacked of the movable stacking support. The sensing means may take the form of a angle bar operatively coupled to the downstream end of the second conveyor section and a linear voltage differential transformer operatively coupled to the angle bar. Vertical displacement of the top of the stack of sheet materials being stacked moving the angle bar and causing a sensing arm of the linear voltage differential transformer to be displaced which position is electrically sensed. Motion of the movable stacking support of the stacking workstation is controlled responsive to the sensed signal from the linear voltage differential transformer. The invention also provides for an angle bar guide assembly, the angle bar being slidably connected thereto. The angle bar guide assembly guides the motion of the angle bar. The invention also provides that the downstream end of the second conveyor section includes an arm extending therefrom substantially parallel with the pivotal axis of the upstream end of the second conveyor section and the apparatus includes a "C" shaped arm receiving portion fixed to the angle bar and adapted to receive the arm extending from the second conveyor section.

Another feature of the invention is the provision that the first conveyor section and the second conveyor section each includes adjustable longitudinal mounting means for selectively adjusting the distance between the upstream and the downstream end of each the first conveyor section and the second conveyor section. The invention further provides that the downstream end of the first conveyor section be aligned with the downstream end of the lower conveyor.

Another feature of the invention is the provision of a transfer section operatively connected to the downstream end of the first conveyor section and the upstream end of the second conveyor section, the first and the second conveyor sections having a continuous belt. The transfer section includes belt rollers arranged to permit pivotal action between the first and second conveyor sections while retaining the belt in contact between the upstream and a downstream end of each the first and the second conveyor sections. The invention further provides a belt tensioning means operatively connected to the continuous belt for retaining the continuous belt under a substantially constant tension.

Yet another feature of the present invention is the provision for pivotal limit means operatively connected to the downstream end of the first conveyor section for limiting the pivotal motion of the first conveyor section.

Still yet another feature of the present invention is the provision for a rider skid operatively connected to the angle bar and adapted to ride on the top of the stack of sheet materials being formed and to retain the downstream end of the second conveyor section operatively coupled to and spaced from the top of stack of sheet materials being formed on the stacker platform. A deflector is provided on the downstream side of the downstream end of the second conveyor section and is adapted to deflect the downstream end of the second conveyor section when an interceptor is positioned to accept sheet materials for a succeeding stack being formed. The deflector protects the belt on the upper conveyor from contact with the interceptor during the positioning of the interceptor.

Other features and advantages and a fuller understanding of the invention will be had from the following detailed description and the accompanying drawings.

BEST MODE FOR CARRYING OUT THE INVENTION

Figure 1:
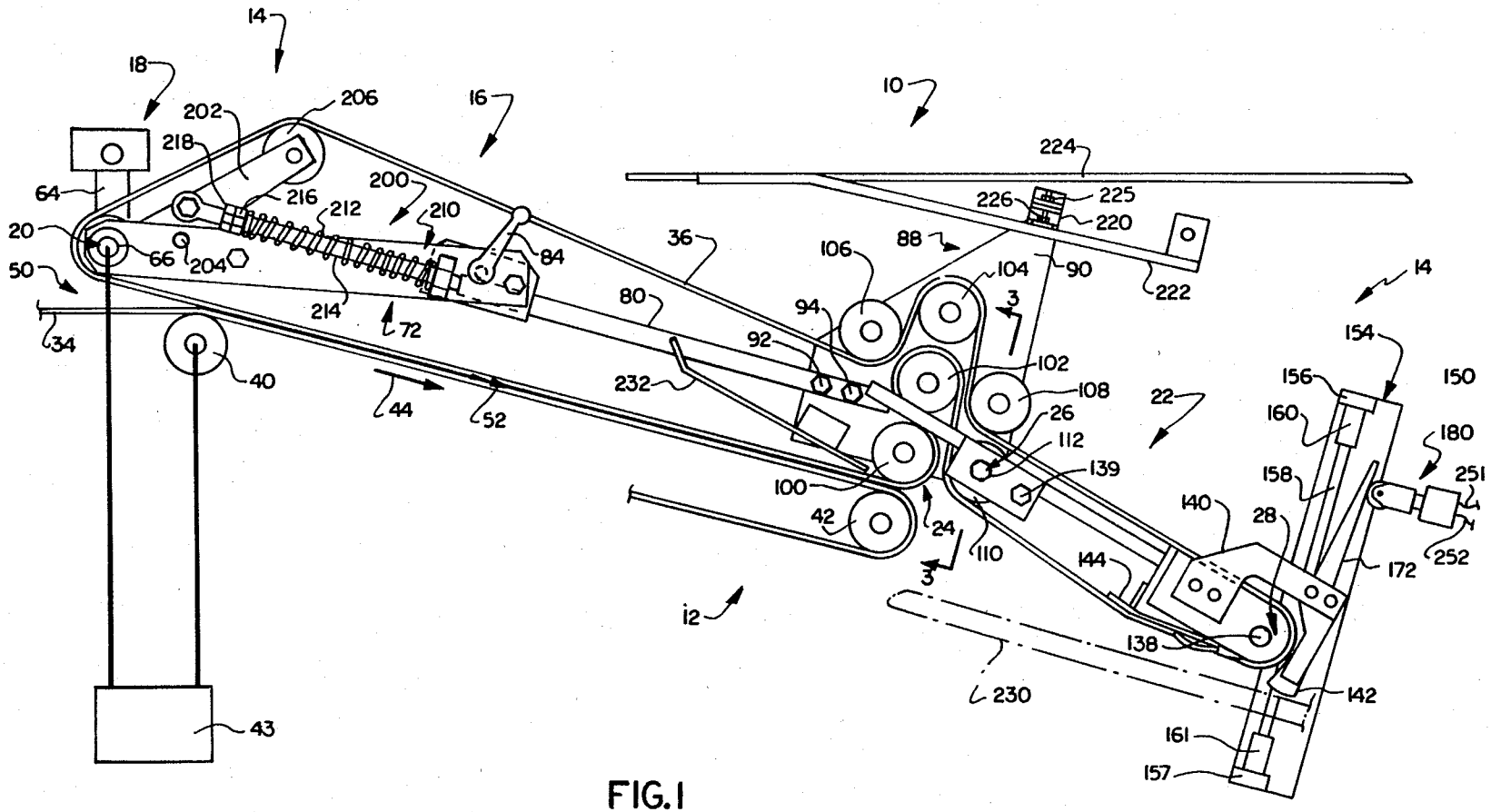
FIG. 1 is a side elevational view partially in fragmentary form showing a conveyor assembly in accordance with the present invention.

A description of the invention follows, referring to the drawings in which like reference numerals denote like elements of structure in each of the several figures.

Figure 2:
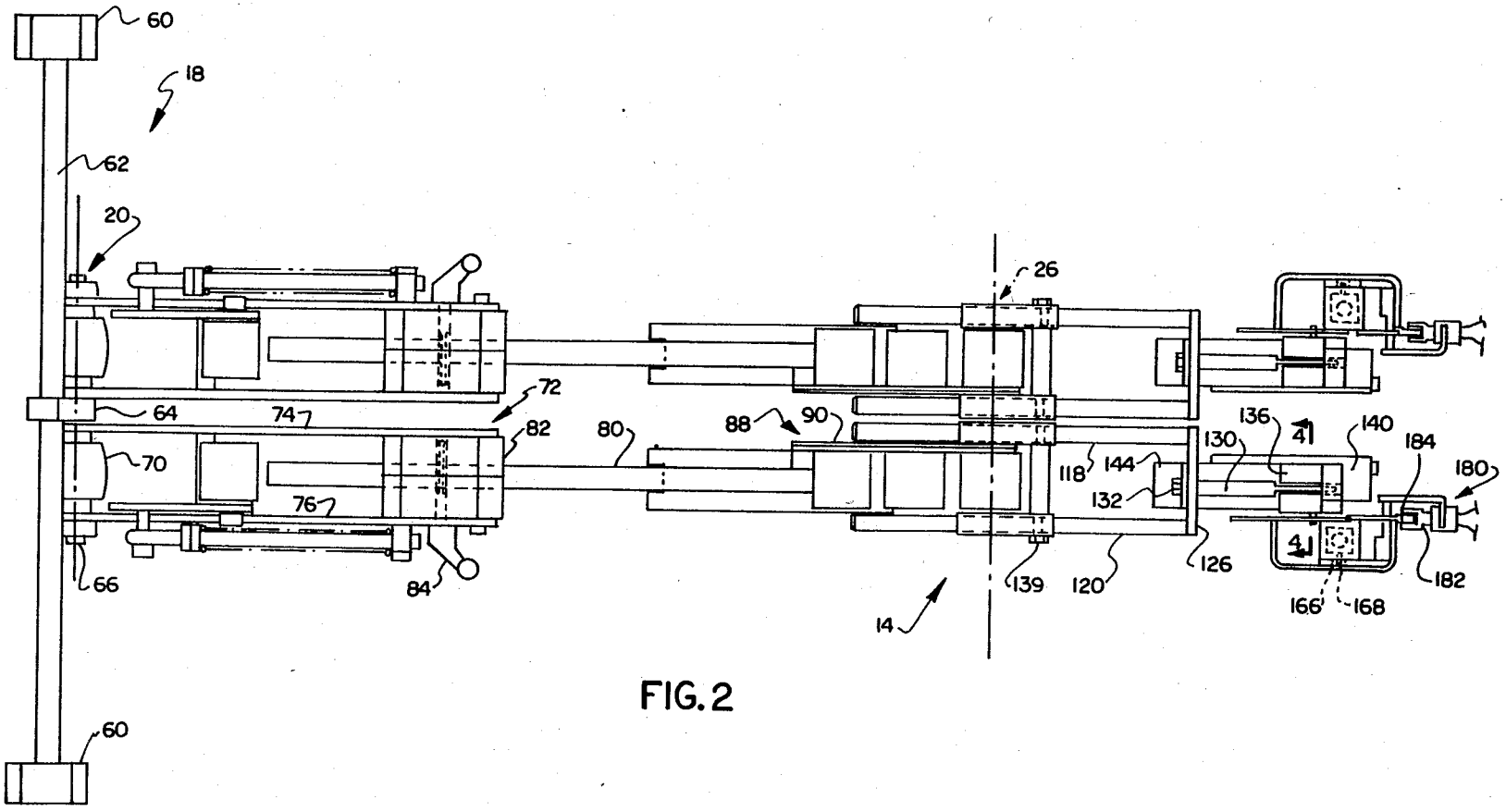
FIG. 2 is a top plan view of a upper conveyor portion of the conveyor assembly in accordance with the present invention with some parts removed for clarity.

Referring now to FIGS. 1 and 2, a conveyor assembly 10 is provided including two lower conveyor portions 12 and two upper conveyor portions 14. Each of the two upper and lower conveyor portions are positioned side by side and are mirror image constructions of the respective other upper and lower conveyor portions. Therefore, for simplicity purposes, only one upper conveyor portion and its associated lower conveyor portion will be described in detail, it being understood that the mirror image other upper and lower conveyor portions are constructed and work in a similar manner.

The lower conveyor 12 is disposed between a source location and a stacking workstation, this being described in further detail below. The upper conveyor portion 14 has a first conveyor section 16 pivotably connected to a stationary frame 18 at an upstream pivot axis 20. The first conveyor section 16 is positioned above a downstream end section of the lower conveyor portion 12.

The upper conveyor portion 14 also includes a second conveyor section 22 pivotally connected adjacent a downstream end 24 of the first conveyor section 16 at an upstream pivot axis 26 of second conveyor section 22. A downstream end 28 of the second conveyor section 22 is adapted to be operatively coupled to the top of a stack of signatures being formed at a stacking workstation, this being described in further detail below.

Lower conveyor portion 12 includes a conveyor belt 34. Upper conveyor portion 14 includes a continuous conveyor belt 36 common to both the first conveyor section 16 and the second conveyor section 22. The first conveyor section 16 and the lower conveyor 12 sandwich sheet materials between belts 34, 36, this area defining a sandwich portion. The upper conveyor portion 14 articulates in response to the profile of a stream of signatures sandwiched between belts 34, 36.

The lower conveyor portion 12 includes an infeed roller 40 and a downstream end roller 42. The conveyor belt 34 is driven from a drive motor 43 in the direction of arrow 44. Signatures are carried on the belt 34 from a source location to a sandwich infeed location 50 formed by the lower conveyor 12 and the first conveyor section 16. Those skilled in the art will appreciate the need to sandwich signatures prior to the stacking workstation. The feed path 52 just prior to the stacking workstation is inclined downward with respect to horizontal to aid in the stacking process. If the signatures were not sandwiched at the inclined feed path, they would tend to slide under the force of gravity.

It is desirable to have the downstream end roller 42 of the bottom conveyor portion 12 near an upstream end of a stacking platform of a stacking workstation where the signatures are being stacked. Since signatures vary in size, the distance between an upstream end of a stacking platform and a backstop of a stacker is adjustable. The position of the downstream end roller 42 is longitudinally adjustable to position it adjacent to the upstream end of a stacking platform.

Stationary frame 18 has spaced apart mounting members 60 holding a fixed cross member 62. Connecting arm 64 extends centrally from the cross member 62. Shaft 66 is connected to the connecting arm 64, shaft 66 defining the pivot axis 20.

First conveyor section 16 includes an upstream end roller 70 rotatably mounted on the shaft 66. The frame 18 maintains roller 70 spaced a predetermined distance above the belt 34 to form the signature receiving opening 50. First conveyor section 16 further includes a longitudinal part 72 having spaced apart members 74, 76 both pivotably connected to shaft 66 and extending longitudinally downstream from the upstream pivot axis 20.

A connecting shaft 80 is received in a split bore receiving portion 82 of the longitudinal part 72. A threaded handle 84 spans the slit of the split bore receiving portion 82 in a known manner. Rotation of handle 84 urges the split bore closed and thus frictionally retains an upstream portion of the connecting shaft 80 to the longitudinal part 72.

A transfer section 88 includes a roller holding plate 90 fixed to the downstream end of the connecting shaft 80 by means of bolts 92, 94.

First conveyor section 16 includes a downstream end roller 100 rotatably mounted to the roller holding plate 90. Transfer rollers 102, 104 are rotatably mounted to roller holding plate 90 and are in line with downstream end roller 100 of the first conveyor section 16. The connecting shaft 80 is longitudinally adjusted with respect to the first longitudinal part 72 by means of the split bore 82 to have the end roller 100 in line with the downstream end roller 42 of the lower conveyor portion 12. Transfer rollers 106, 108 are rotatably mounted to the roller holding plate 90. Transfer roller 106 is positioned upstream from and approximately half way between transfer rollers 102, 104. Transfer roller 108 is positioned downstream of and approximately in line with transfer roller 102.

Figure 3:
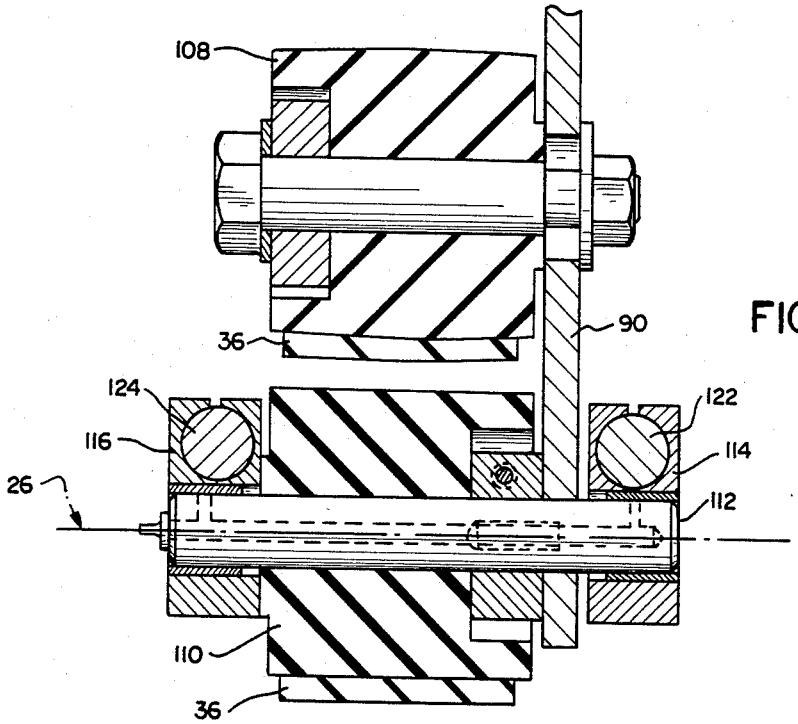
FIG. 3 is a sectional view of a part of the upper conveyor portion of the conveyor assembly on an enlarged scale, as seen from the plane indicated by line 3—3 of FIG. 1.
Figure 4:
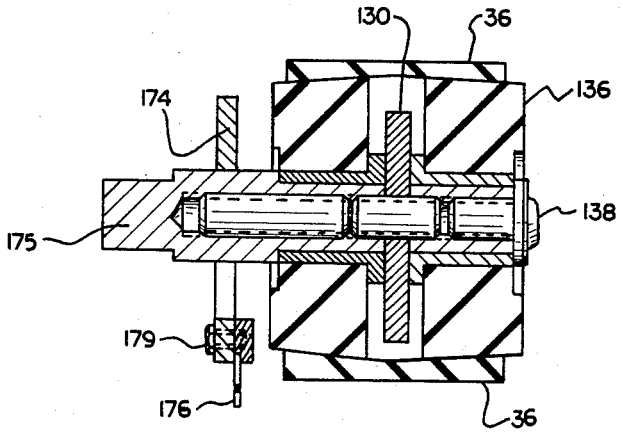
FIG. 4 is a sectional view of a part of the upper conveyor portion of the conveyor assembly on an enlarged scale, as seen from the plane indicated by line 4—4 of FIG. 2.
Figure 5:
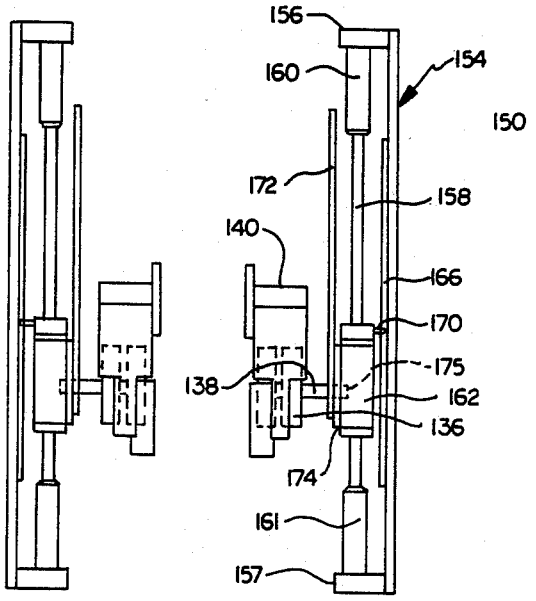
FIG. 5 is a side elevational view of an angle bar assembly of the conveyor assembly.

Second conveyor section 22 includes an upstream end roller 110 rotatably mounted to roller holding plate 90 on a shaft 112 defining pivot axis 26. Referring now to FIG. 3, shaft 112 extends through roller holding plate 90 and upstream end roller 110. Spaced apart split bore mounting members 114, 116 are pivotably mounted to opposed ends of shaft 112. Second conveyor section 22 includes spaced apart longitudinal mounting members 118, 120, see FIG. 2, respectively adapted to be received in bores 122, 124 of the mounting members 114, 116. Connecting plate 126 connects the downstream ends of longitudinal mounting members 118, 120 in fixed spaced apart relationship to each other. It will be appreciated that the members 118, 120 are pivotably connected to the roller holding plate 90 about pivot axis 26 by shaft 112. The upstream end of the second conveyor section 22 is thus pivotably mounted adjacent the downstream end 24 of the first conveyor section 16.

Second conveyor section 22 includes longitudinal arm 130 fixed to the plate 126 connecting the members 118, 120 by means of bolt 132. A downstream end roller 136 is rotatably mounted to a downstream end of longitudinal arm 130 by means of shaft 138. It will be appreciated that the longitudinal distance between the downstream end roller 136 and the upstream end roller 110 is adjustable by means of the split bore arrangement of split bore mounting members 114, 116 and tightening nut 139.

An interceptor deflector 140 is connected to the mounting member 130 of the second conveyor section 22 and includes an end piece 142 adapted to contact an interceptor positioned from a stacking workstation to insure a distance between the interceptor and the belt 36 of the upper conveyor portion.

A belt guide 144 is fixed to plate 126 and is positioned upstream of end roller 136. The function of belt guide 144 is described below.

A vertical displacement sensing assembly 150 is operatively coupled to the downstream end 28 of the upper conveyor portion 14. Referring now to FIGS. 1, 4, 5 and 6, the vertical displacement sensing assembly 150 includes a fixed bracket assembly 154 having transverse extension arms 156, 157. Shaft 158 having stops 160, 161 spans the transverse extension arms 156, 157. A sliding cylinder 162 is mounted on the shaft 158 and can slide on the shaft between the stops 160, 161. Guide bars 166 having a slot 168 are fixed to the fixed bracket 154, FIG. 2. A guide pin 170 is fixed to and extends from the cylinder 162 and is received in the slot 168 to prevent the cylinder from rotating about the shaft 158. An angle bar 172 is pivotably fixed to a "C" shaped shaft receiving part 174. The receiving part 174 is fixed to the cylinder 162.

Shaft 138 of the downstream end roller 136 has an extending arm portion 175 which is received in the shaft receiving part 174. The "C" shaped opening of the shaft receiving part 174 is larger than the diameter of the shaft extending arm 175. A rider skid 176 is operatively connected to a finger 178 of the shaft receiving part 174 by means of a bolt clamp 179. The rider skid 176 is parabolic in shape and is adapted to contact the top of the sheet materials being stacked. It will be appreciated that this arrangement operatively couples the downstream end of the second conveyor section with the top of stack of signatures being stacked at the workstation. When the vertical position of the top of the stack changes, the rider skid 176 will be vertically displaced responsive to the change in position of the top of the stack. As the rider skid vertically moves, the angle bar 172 will vertically move. Those skilled in the art will further appreciate that the lose fit between the shaft 138 and the receiving part 174 provides an amount of hysteresis between the motion of the angle bar 172 and the downstream end of the upper conveyor portion 14. Also, it is desirable to have the downstream end roller 136 as near to the back stop of the stacker as possible. Therefore, when the longitudinal position of the downstream end roller 100 is adjusted to be in line with the downstream end roller 42, the downstream end roller 136 is adjusted to remain near the back stop of the stacker by means of the split bore members 114, 116. The lose fit between shaft 138 and the receiving part 174 also permits this longitudinal adjustment. It will be appreciated that second conveyor section 22 maintains a drive engagement with the signatures as they are stacked.

Figure 6:
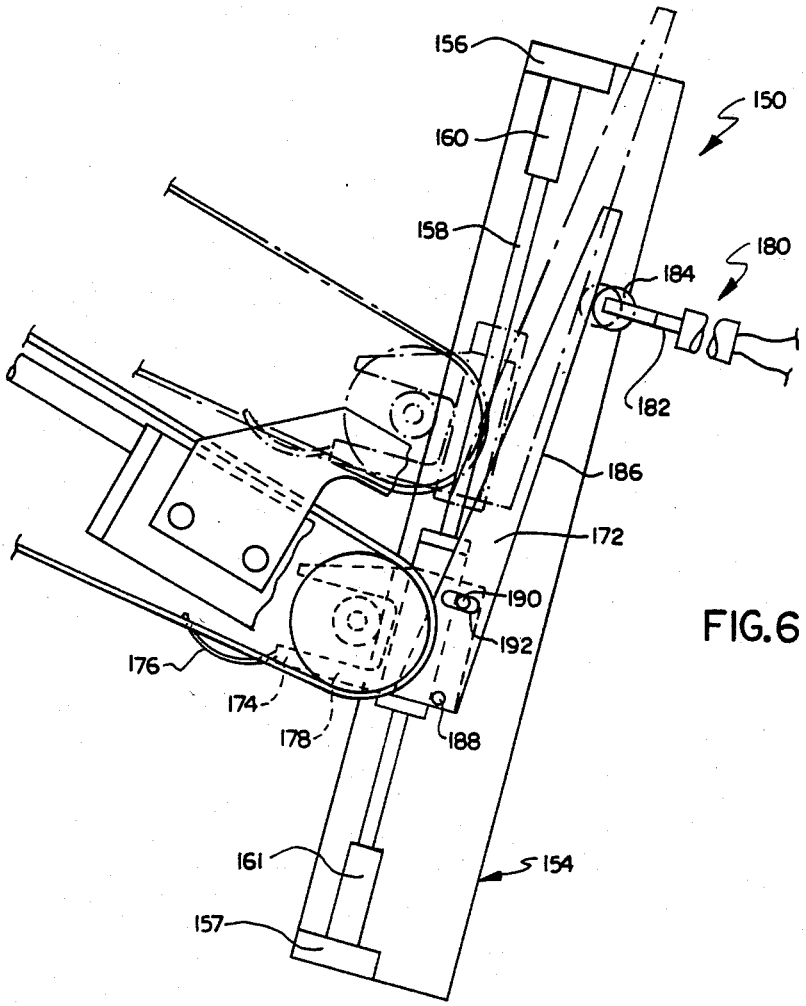
FIG. 6 is a side elevation view of a portion of the conveyor assembly shown in FIG. 1, on an enlarged scale, schematically illustrating the operation of the angle bar in accordance with the invention.

Referring to FIG. 6, a linear voltage differential transformer 180 is fixed to the bracket assembly 154 and includes a sensing arm 182 with a roller 184 fixed to the end of the arm 182. The linear voltage differential transformer 180 is position so that roller 184 rides against surface 186 of the angle bar 172. As the angle bar is vertically displaced, the surface 186 is correspondingly displaced longitudinally. It will be appreciated that the angle bar converts vertical motion into longitudinal motion. The arm 182, which is spring biased to retain the roller 184 in contact with the surface 186, reciprocates in response to the longitudinal motion of the angle bar 172. It will be appreciated that the linear voltage differential transformer is sensing vertical position of the rider skid 176 and thus the top of the stack of sheet materials being stacked. Angle bar 172 is fixed to the receiving part 174 at one end by means of a bolt 188 and a bolt 190 received through a slot 192 on the angle bar 172 at a location spaced from bolt 188. This attachment arrangement permits an initial angular adjustment of the angle bar 172 with respect to the fixed bracket assembly 154.

Referring again to FIG. 1, a tensioning assembly 200 is connected to the to the first longitudinal part 72 of the first conveyor section 16. A tensioning arm 202 is mounted to longitudinal part 72 by pivot pin 204. A roller 206 is rotatably mounted to the other end of arm 202. A spring bias telescoping rod assembly 210 is connected to the tensioning arm 202 and to longitudinal part 72. A spring 212 surrounds a rod 214 and applies a bias force against the tensioning arm 202. The amount of biasing force is adjustable by means of adjustment nuts 216, 218.

A lower conveyor belt 34 contacts roller 40 and goes around roller 42. The lower conveyor belt 34 is an endless belt and is driven by a drive motor 43 in the direction of arrow 44.

A upper conveyor belt 36 is an endless belt. Starting with roller 70, the belt contacts roller 100 and is rapped in a counter clockwise direction around a portion of roller 100. The belt is then rapped around roller 102 clockwise, counter clockwise around roller 110, to belt guide 144, counter clockwise around roller 136, clockwise around a portion of roller 108, counter clockwise around roller 104, clockwise around roller 106, counter clockwise around roller 206 and returns counter clockwise around roller 70. Belt guide 144 flattens the belt upstream of end roller 136 to have the belt in the same plane as the signatures being stacked. The spring bias assembly 200 maintains the belt 36 in an adjustable amount of tension by adjusting the spring bias force against arm 202. Belt 36 also moves in the direction of arrow 44. The transfer section 88 maintains the belt 36 in contact with the upstream and downstream rollers of each the first conveyor section 16 and the second conveyor section 22. The belt 36 and belt 34 are both driven from a common source so that they have matched movement. One of the rollers in the upper conveyor 14 can be driven from the drive motor 43 driving the lower convey by utilizing flexible shafts. It has been found that driving roller 70 of the upper conveyor eliminates the need for flexible shafts since roller 70 is fixed in space both vertically and horizontally.

Transfer section 88 includes a "L" shaped adjustment bracket 220 fixed to the roller holding plate 90. The bracket 220 extends over a fixed member 222 which is fixed to and angled with respect to a horizontal fixed member 224 approximately equal to the incline of the feed path 52. A bolt 225 is threaded though the bracket 220 and contacts an upper surface 226 of member 222. It will be appreciated that the first conveyor section is pivotable at one end about a pivotal axis 20. Bolt 225 is used to adjust the spatial relationship between roller 100 and roller 42. It is preferable that there be a small gap between the belts at the position of rollers 100, 42 to ease frictional forces between the upper and lower conveyor belts. The bolt 225 thus acts as a stop to limit the pivotal motion of the first conveyor section 16.

The second conveyor section pivots about an axis 26 in response to pivotal motion of the first conveyor section 16 or in response to the position of rider skid 176 as it rides on the signatures being stacked on the stacker. FIG. 1 shows an interceptor 230 in a ready position with no signatures on it.

A belt deflector guide 232 is fixed to the roller holding plate 90 and is angled upstream away from the feed path 52. The operation of the belt deflector guide 52 will be discussed below.

Figure 7:
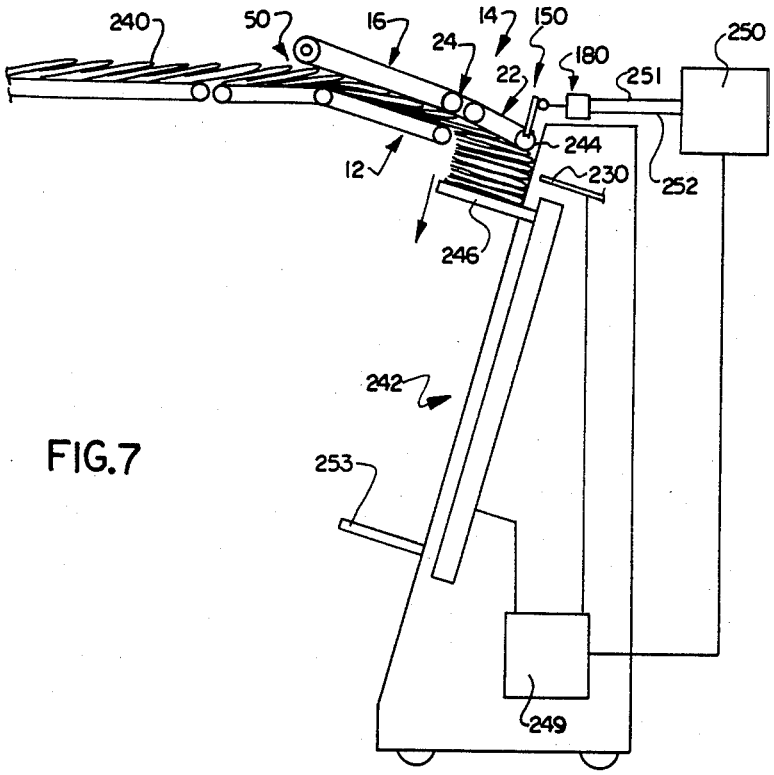
FIG. 7 is a schematic illustration of a conveyor assembly in accordance with the present invention with signatures feeding to a stacker.

The operation of the conveyor assembly 10 will be appreciated by referring to FIGS. 7, 8 and 9A–9C. FIG. 7 shows a stream of shingled signatures 240 coming from a source location such as a collator and moving along a lower conveyor 12 into the infeed section 50 formed by the lower conveyor 12 and the upper conveyor 14. The signatures are being transported to a stacking workstation 242 of the type disclosed in pending U.S. Patent application of Mohanjit Singh Chandhoke, U.S. Ser. No. 518,015, which is incorporated herein by reference. The profile or height of the signatures causes the downstream end 24 of the first conveyor section 16 to pivot up slightly to accommodate the profile of the signatures. The second conveyor section pivots with respect to the first conveyor section to keep the downstream end of the second conveyor section operatively coupled to the top of the signatures 244 being stacked on a platform 246 of the stacking workstation 242. As the signatures are stacked on the platform 246, the platform is made to descend by means of a motor 249 and a motor control circuit 250. After a stack is completed, the platform 246 descends to transfer the stack to intermediate platform 253. An interceptor 230 is immediately placed in position to receive signatures to form a new stack. The interceptor 230 descends as signatures are stacked, the descent being controlled by motor 249 and motor control circuit 250. After the signatures are removed from the intermediate platform 253, the platform 246 moves up to the interceptor 230 and takes over holding the new stack. The interceptor 230 is retracted and moves back to the position shown in FIG. 7.

Figure 8:
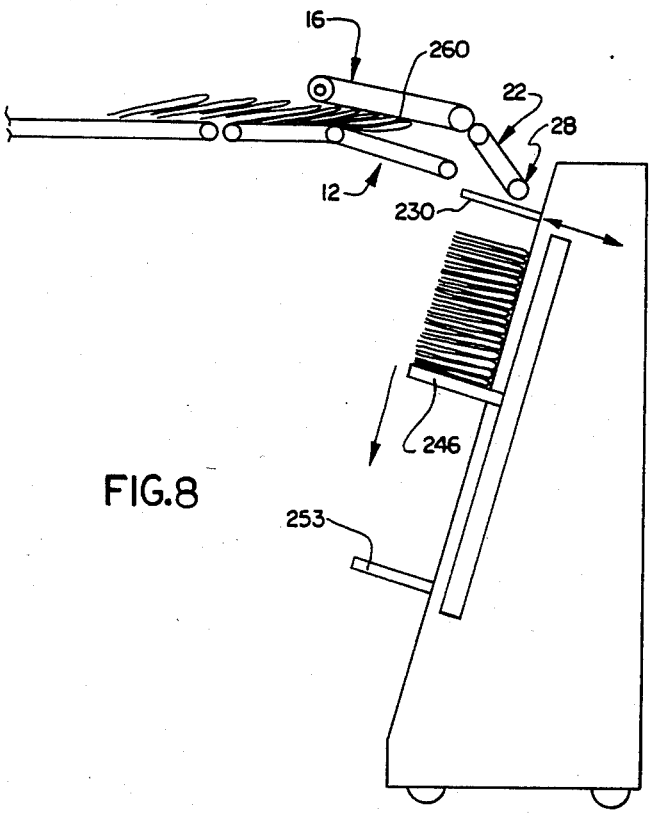
FIG. 8 is a schematic illustration of a conveyor assembly in accordance with the present invention with the upper conveyor portion articulating to accommodate a slug of signatures feeding to a stacker.

Referring to FIG. 8, a slug of signatures 260 is sandwiched between the lower conveyor 12 and the first conveyor section 16. A slug is typically formed after it has been determined that a sufficient number of signatures is being fed to a stack or that a stack of a predetermined dimension is completed. A gapper unit located upstream in the conveyor system stops the flow of signatures causing a slug to be formed. Slugs can also be formed in a vertical feed section upstream of the stacking workstation. The position of a platform of a stacker is typically several feet above the floor. A vertical feet section carries the signatures to a height necessary for proper operation of the stacker. Slugs can be formed when there is improper adjustment of belt tension in the vertical feed section.

The downstream end of the first conveyor section 16 pivots a greater amount when a slug enters the sandwich portion between the first conveyor section 16 and the lower conveyor portion 12 than for normal shingled signatures to accommodate the increased height of the slug. The second conveyor section 22 pivots with respect to the first conveyor section 16 to retain the downstream end 28 of the second conveyor section 22 operatively coupled to the interceptor 230 or the top of the stack of signatures being stacked on the interceptor or the platform.

The vertical motion of the platform 246 or the interceptor 230 is controlled by a feedback signal received from the linear voltage differential transformer 180. The motor control circuit 250 monitors the signal from the linear voltage differential transformer 180 which is indicative of the vertical position of the stack and variably adjust the speed of the motor 249. The motion of the platform is either sped up or slowed down as needed to keep the top of the stack at the same vertical height within predetermined limits. If the feed rate of signatures to the platform increases, the downstream end of the second conveyor section will vertically rise which will be sensed by the linear voltage differential transformer 180. In such a case, the descent rate of the platform will be increased by control circuit 250 to lower the top of the stack. If the feeding rate should decrease causing the downstream end of the second conveyor section to drop vertically, the descent rate of the platform will be slowed to cause the vertical position of top of the stack of signatures to rise and remain within the predetermined limits.

Figure 9A:
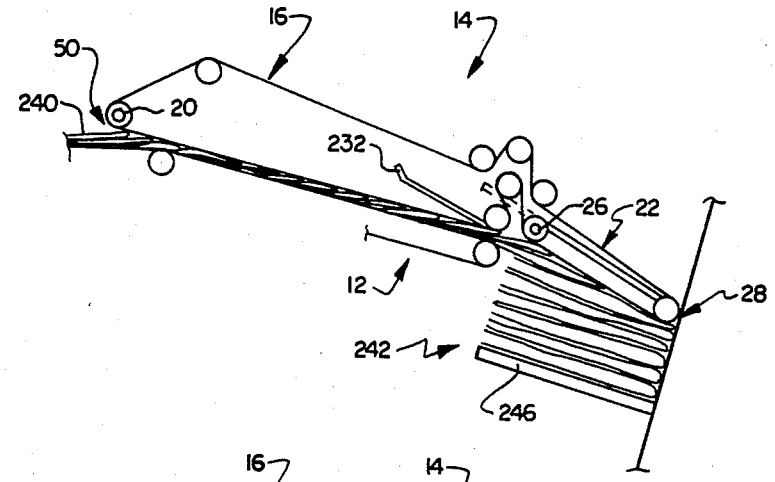
FIGS. 9A–9C are schematic illustrations of the conveyor assembly in accordance with the present invention showing streams of sheet materials having different profiles and the upper conveyor in correspondingly different degrees of articulation.
Figure 9B:
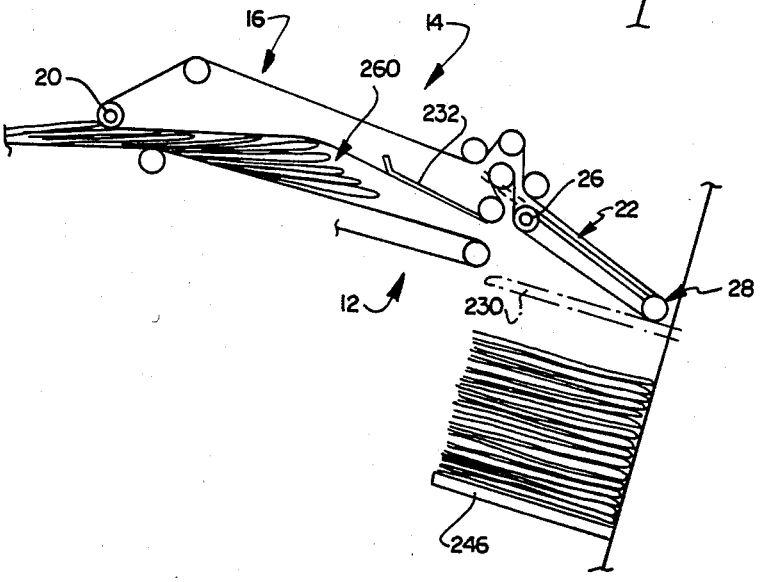
Figure 9C:
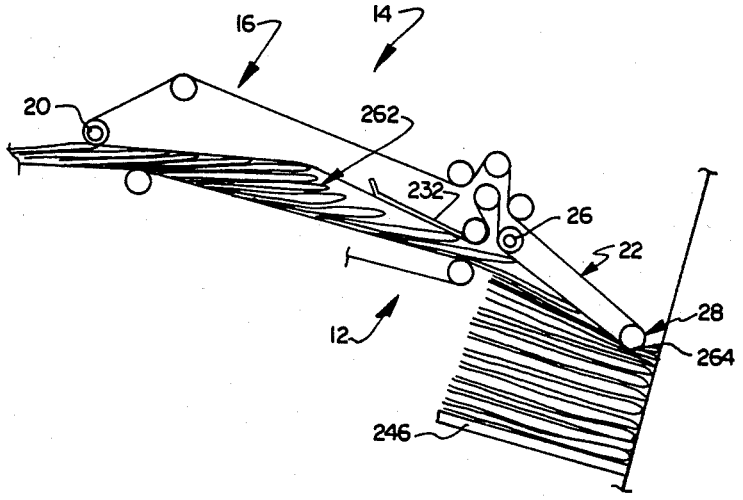

The articulating action of the upper conveyor 14 can be better appreciated referring to FIGS. 9A–9C. FIG. 9A shows an even, continuous feed of signatures being transported from a source location to the stacking workstation 242. First conveyor section 16 pivots about axis 20 to accommodate the profile of the signatures 240. Second conveyor section 22 pivots about axis 26 to retain downstream end 28 operatively coupled with the top of the stack of signatures being stack on the platform 246.

FIG. 9B shows a slug of signatures 260 of the type formed by a gapper in the sandwich portion between first conveyor section 16 and lower conveyor 12. First conveyor section 16 pivots about axis 20 an amount sufficient to accommodate the slug profile. Belt 36 will deflect in the sandwich portion because of the slug. Belt deflector guide 232 limits the amount of deflection. Even though the belt 36 is deflected, a constant tension is retained by tensioning assemble 200. Second conveyor section 22 pivots about axis 26 to retain downstream end 28 operatively coupled to the interceptor 230.

FIG. 9C Shows a slug 262 of the type formed in a vertical feed section, the slug located in the sandwich portion between first conveyor section 16 and lower conveyor 12. First conveyor section 16 pivots about axis 20 to accommodate the slug profile. Belt deflector guide 232 limits the amount of belt deflection in the sandwich portion. Second conveyor 22 pivots about axis 26 to retain downstream end 28 operatively coupled to the top 264 of the stack of signatures being stacked on platform 246.

It will be appreciated that the second conveyor section 22 pivots with respect to the first conveyor section 16 because of the force of gravity.

Only one upper conveyor portion and its associated lower conveyor has been described. Both of the lower conveyors lie in the same stationary plane. The two upper conveyors articulate independent of each other with a common pivot axis being axis 20. The articulating upper conveyor maintains a positive drive engagement to urge the signatures against the backstop of the stacker.

This invention has been described with reference to preferred embodiments. Modifications and alterations may occur to others upon reading and understanding this specification. It is my intention to include all such modifications and alterations insofar as they come within the scope of the appended claims or the equivalent thereof.

I claim:

1. An apparatus for feeding a stream of sheet materials from a source location to a stacking workstation, said apparatus comprising:

a lower conveyor located between said source location and said stacking workstation, said lower conveyor transporting sheet materials from said source location to said stacking workstation;

an upper conveyor including a first conveyor section positioned above an end portion of said lower conveyor near said stacking workstation, said first conveyor section and said lower conveyor sandwiching said stream of sheet materials therebetween as said sheet materials are transported to said stacking workstation, said first conveyor section being pivotably fixed at an end upstream of said stacking workstation, said upper conveyor further including a second conveyor section pivotably mounted adjacent a downstream end of said first conveyor section, said second conveyor section extending beyond a downstream end of said lower conveyor and over a movable loading support of said stacking workstation, a downstream end of said second conveyor section adapted to be operatively coupled to a top of a stack of sheet materials being stacked on said movable loading support, sheet materials entering a sandwich portion between said first conveyor section and said lower conveyor causing said downstream end of said first conveyor section to pivot away from said lower conveyor, said second conveyor section pivoting with respect to said first conveyor section retaining said downstream end of said second conveyor section operatively coupled to the top of the stack of sheet materials being stacked;

drive means operatively connected to said lower conveyor and said upper conveyor for driving belts of said lower and said upper conveyors; and vertical component sensing means operatively coupled to said top of the stack of sheet materials being stacked for sensing a vertical position thereof, said vertical component sensing means comprising an angle bar operatively coupled to the top of the stack of sheet materials being stacked and a linear voltage differential transformer operatively coupled to said angle bar, vertical displacement of said top of the stack of sheet materials being stacked moving said angle bar, said linear voltage differential transformer sensing a position of said angle bar.

2. The apparatus of claim 1 wherein motion of said movable loading support is responsive to a sensed signal from said linear voltage differential transformer.

3. The apparatus of claim 1 further including an angle bar guide assembly, said angle bar being slidably connected thereto, said angle bar guide assembly guiding motion of said angle bar in response to said vertical displacement of said top of the stack of sheet materials being stacked.

4. The apparatus of claim 3 wherein said downstream end of said second conveyor section includes an arm extending therefrom substantially parallel with a pivotal axis of the upstream end of said second conveyor section and said apparatus further includes a "C" shaped arm receiving member attached to said angle bar and adapted to receive said arm extending from said second conveyor section, said downstream end of said second conveyor section being operatively coupled to said angle bar.

5. The apparatus of claim 4 further including a rider skid operatively connected to said "C" shaped arm receiving member and adapted to retain said downstream end of said second conveyor section vertically spaced a distance from said top of the stack of sheet material being stacked on said movable loading support.

6. An apparatus for feeding a stream of sheet materials from a source location to a stacking workstation, said apparatus comprising:

a lower conveyor located between said source location and said stacking workstation, said lower conveyor transporting sheet materials from said source location to said stacking workstation;

an upper conveyor including a first conveyor section positioned above an end portion of said lower conveyor near said stacking workstation, said first conveyor section and said lower conveyor sandwiching said stream of sheet materials therebetween as said sheet materials are transported to said stacking workstation, said first conveyor section being pivotably fixed at an end upstream of said stacking workstation, said upper conveyor further including a second conveyor section pivotably mounted adjacent a downstream end of said first conveyor section, said second conveyor section extending beyond a downstream end of said lower conveyor and over a movable loading support of said stacking workstation, a downstream end of said second conveyor section adapted to be operatively coupled to a top of a stack of sheet materials being stacked on said movable loading support, sheet materials entering a sandwich portion between said first conveyor section and said lower conveyor causing said downstream end of said first conveyor section to pivot away from said lower conveyor, said second conveyor section pivoting with respect to said first conveyor section retaining said downstream end of said second conveyor section operatively coupled to the top of the stack of sheet materials being stacked;

drive means operatively connected to said lower conveyor and said upper conveyor for driving belts on said lower and said upper conveyors; and transformer section operatively connected to said downstream end of said first conveyor section and an upstream end of said second conveyor section, said first and said second conveyor sections having a continuous, common belt, said transfer section including belt rollers arranged to permit pivotal action between said first and said second conveyor sections while retaining belt contact between said upstream and downstream end of each said first and said second conveyor sections.

7. The apparatus of claim 6 further including belt tensioning means operatively connected to said continuous belt for retaining said continuous belt under a substantially constant tension.

8. An apparatus for feeding a stream of sheet materials from a source location to a stacking workstation, said apparatus comprising:

a lower conveyor located between said source location and said stacking workstation, said lower conveyor transporting sheet materials from said source location to said stacking workstation;

an upper conveyor including a first conveyor section positioned above an end portion of said lower conveyor near said stacking workstation, said first conveyor section and said lower conveyor sandwiching said stream of sheet materials therebetween as said sheet materials are transported to said stacking workstation, said first conveyor section being pivotably fixed at an end upstream of said stacking workstation, said upper conveyor further including a second conveyor section pivotably mounted adjacent a downstream end of said first conveyor section, said second conveyor section extending beyond a downstream end of said lower conveyor and over a movable loading support of said stacking workstation, a downstream end of said second conveyor section adapted to be operatively coupled to the top of the stack of sheet material being stacked on said movable loading support, sheet materials entering said sandwich portion causing said downstream end of said first conveyor section to pivot away from said lower conveyor, said second conveyor section pivoting with respect to said first conveyor section retaining said downstream end of said second conveyor section operatively coupled to a top of a stack of sheet materials being stacked on said movable loading support;

said first conveyor section and said second conveyor section each including adjustable, longitudinal mounting means for selectably adjusting the distance between an upstream and the downstream end of each said first conveyor section and said second conveyor section, said downstream end of said first conveyor section position to be aligned with said downstream end of said lower conveyor;

drive means operatively connected to said lower conveyor and said upper conveyor for driving belts on said lower and said upper conveyors;

a transfer section operatively connected to said downstream end of said first conveyor section and said upstream end of said second conveyor section, said first and said second conveyor sections having a continuous, common belt, said transfer section including belt rollers arranged to permit pivotal action between said first and said second conveyor sections while retaining belt contact between said upstream and downstream end of each said first and said second conveyor sections;

belt tensioning means operatively connected to said continuous belt for retaining said continuous belt under a substantially constant tension;

pivotal limit and adjustment means operatively connected to said downstream end of said first conveyor section for limiting the pivotal motion of said first conveyor section and for adjusting spacing between the downstream end of the lower conveyor and the downstream end of the first conveyor section;

vertical component sensing means operatively coupled to said top of the stack of sheet materials being stacked on said movable loading support for sensing vertical position thereof, said vertical component sensing means including an angle bar operatively coupled to the downstream end of said second conveyor section and a linear voltage differential transformer operatively coupled to said angle bar, vertical displacement fo said top of the stack of sheet materials being stacked on said movable loading support moving said angle bar, said linear voltage differential transformer sensing movement of said angle bar, motion of said movable loading support responsive to a sensed signal from said linear voltage differential transformer;

an angle bar guide assembly, said angle bar being slidably connected thereto, said angle bar guide assembly guiding motion of said angle bar in response to vertical displacement of said top of the stack of sheet materials being stacked on said movable loading platform, said downstream end of said second conveyor section including an arm extending therefrom substantially parallel with a pivotal axis of the upstream end of said second conveyor section and said apparatus further including a "C" shaped arm receiving portion fixed to said angle bar and adapted to receive said arm extending from said second conveyor section, said downstream end of said second conveyor section being operatively coupled to said angle bar; and a rider skid operatively connected to said "C" shaped arm receiving member and adapted to retain said downstream end of said second conveyor section vertically spaced a distance from sheet material on said stacker platform.

9. An apparatus for feeding a stream of sheet materials from a source location to a stacking station where the sheet materials are received on a downwardly movable stack support, said apparatus comprising conveyor means for feeding the stream of sheet materials to the stacking station, sensing means for sensing the vertical position of the top of the stack of sheet materials being stacked, and means for retaining said sensing means operatively coupled to the top of the stack of sheet materials being stacked, said conveyor means comprising a lower conveyor located between said source location and said stacking station, an upper conveyor positioned above an end portion of said lower conveyor near said stacking station, said upper conveyor and said lower conveyor sandwiching said stream of sheet materials therebetween as said sheet materials are transported to said stacking station, and means supporting said upper conveyor for pivotal movement both about an end thereof upstream of said stacking station and away from said lower conveyor in response to a slug of sheet materials or a change in profile of sheet materials entering between said upper and lower conveyors; and said means for retaining said sensing means operatively coupled to the top of the stack of sheet materials being stacked comprising another conveyor section extending over said downwardly movable stack support and having an upstream end pivotally mounted adjacent the downstream end of said upper conveyor and a downstream end operatively coupled to the top of the stack of sheet materials being stacked on said downwardly movable stack support, said sensing means being mounted on said downstream end of said another conveyor section, and means for pivoting said another conveyor section relative to said upper conveyor in response to pivotal movement of said upper conveyor to retain said downstream end of said another conveyor section and said sensing means operatively coupled to the top of the stack of sheet material being stacked even when a slug of sheet materials is located between said upper and lower conveyors.

10. The apparatus of claim 9 wherein said downstream end of said upper conveyor is aligned with a downstream end of said lower conveyor.

11. The apparatus of claim 9 further including means for limiting pivotal movement of said upper conveyor and for adjusting the gap between downstream ends of said lower and upper conveyors.

12. The apparatus of claim 9 wherein said upper conveyor and said another conveyor section have a continuous common belt, and said means for pivoting said another conveyor section relative to said upper conveyor comprises a transfer section operatively connected to said downstream end of said upper conveyor and said upstream end of said another conveyor section for supporting the downstream roller of said upper conveyor and for pivotally supporting the upstream roller of said another conveyor section.

13. The apparatus of claim 9 wherein said sensing means includes an angular bar and bracket means for supporting said angular bar, and said downstream end of said another conveyor section includes an arm extending therefrom and received in said bracket to couple said angular bar to said downstream end of said another conveyor section.

* * * * *